US005383953A

United States Patent [19]

Christini

[11] Patent Number: 5,383,953

[45] Date of Patent: Jan. 24, 1995

[54] METHOD OF PRODUCING MAGNESIUM VAPOR AT ATMOSPHERIC PRESSURE

[75] Inventor: Roy A. Christini, Washington Township, Washington County, Pa.

[73] Assignee: Aluminum Company of America, Pittsburgh, Pa.

[21] Appl. No.: 190,988

[22] Filed: Feb. 3, 1994

[51] Int. Cl.[6] ..... C22B 26/22

[52] U.S. Cl. ..... 75/10.19; 75/10.33; 75/597

[58] Field of Search ..... 75/597, 10.19, 10.33

[56] References Cited

U.S. PATENT DOCUMENTS

| | | |
|---|---|---|
| 2,920,951 | 1/1960 | Bretschneider et al. . |
| 2,971,833 | 2/1961 | Artru et al. . |
| 3,404,078 | 10/1968 | Goldberger . |
| 4,190,434 | 2/1980 | Bonfils et al. . |
| 4,478,637 | 10/1984 | Christini et al. . |
| 4,498,927 | 2/1985 | Bowman et al. . |
| 4,543,122 | 9/1985 | Bodenstein et al. . |
| 4,572,736 | 2/1986 | Warren et al. . |
| 4,699,653 | 10/1987 | Barcza et al. . |
| 5,090,996 | 2/1992 | Cameron ..... 75/597 |

OTHER PUBLICATIONS

Christini et al., "Aluminothermic Magnetherm: Development Of Aluminum Skim And Aluminum Shot As Reductants" Proceedings Of The Reinhardt Schuhmann International Symposium; Published By The Metallurgical Society, Inc.; Nov. 1986, pp. 965–986.

Cameron et al., "Extractive Metallurgy Of Magnesium", Proceedings Of The Magensium Technology Conference; Published By The Institute Of Metals, London , England; Nov. 1986, pp. 7–17.

Gaye et al., "Thermodynamics Of Slags: Use Of A Slag Model To Describe Metallurgical Reactions", Memoires et Etudes Scientifiques Revue de Metallurgie, vol. 86, No. 4, Apr. 1989, pp. 237–244.

*Primary Examiner*—Melvyn J. Andrews

*Attorney, Agent, or Firm*—Gary P. Topolosky; David V. Radack

[57] ABSTRACT

A method of producing magnesium vapor at substantially atmospheric pressure. The method comprises feeding into the reaction zone of a reduction furnace magnesium-oxide containing materials and metal reductants and then heating the magnesium-oxide containing materials and the metal reductants in the reaction zone to an operating temperature to create a slag composition. The slag composition has a phase diagram including a two-phase liquid and solid region. The feeding of the magnesium-oxide containing material and the metal reductant into the furnace bath are controlled such that the slag composition at the operating temperature is within the two-phase liquid and solid region of the phase diagram. In this way, reactions occur to produce magnesium vapor at substantially atmospheric pressure. A method of producing magnesium metal is also disclosed.

19 Claims, 4 Drawing Sheets

METHOD OF PRODUCING MAGNESIUM VAPOR AT ATMOSPHERIC PRESSURE

BACKGROUND OF THE INVENTION

This invention relates to a method of producing magnesium vapor at atmospheric pressure.

Magnesium is produced industrially by several different processes. One of these processes is the so-called Magnetherm Process described in U.S. Pat. No. 2,971,833. The Magnetherm Process involves a reaction between a metallic reducing agent and magnesium-oxide in the presence of a liquid mixture of oxides in a reaction zone which is heated by the electrical resistance of the mixture of oxides. In carrying out this process, a magnesium oxide ore, such as calcined dolomite, and a reducing agent comprised of silicon, ferrosilicon or an alloy of aluminum and ferrosilicon are charged to the reaction zone of a reaction-condensation system. Aluminum oxide is also added to the reaction zone and the composition of the total charge is controlled so that a particular liquid slag mixture of calcium, silicon, aluminum and magnesium oxides, is formed and maintained in the reaction zone. Existing Magnetherm Processes are typically operated at 1550° C. and at low pressures, such as 70 torr (0.09 atmospheres). A vacuum must be used in order to remove the magnesium vapor from the vessel to a condenser, where the vapor is condensed in order to form magnesium metal. This low pressure operation often leads to low magnesium recovery due to oxidation of the liquid and gaseous magnesium wherever an air leak occurs.

There have been disclosed Magnetherm Processes which operate at atmospheric pressure (or 760 torr). U.S. Pat. No. 5,090,996, the disclosure of which is expressly incorporated herein by reference, discloses using a plasma arc to heat the molten slag in a reaction zone. The plasma arc can generate much higher temperatures (on the order of 1800°–2000° C.) at the reaction zone than conventional electrodes. The patent states that the slag composition should be controlled so that it is wholly within the periclase region of the slag composition phase diagram depicted at FIGS. 1–6 therein, with a substantially constant liquidus temperature of about 1800°–2000° C. and preferably 1900°–1950° C. The patent further states that controlling the molten slag composition and using high temperatures produces magnesium vapor at atmospheric pressure.

Although U.S. Pat. No. 5,090,996 discloses a slag composition that can produce magnesium vapor at atmospheric pressure, there are several shortcomings of the disclosed process that may prevent full and efficient utilization thereof. First, the temperature at the surface of the reaction zone must be maintained at a very high 1900°–1950° C. in order to insure that the slag composition is wholly within the periclase region and wholly within one phase, the liquid phase of said diagram. Current Magnetherm Processes operate at much lower temperatures, around 1550° C. There are several negative consequences of operating at temperatures in excess of 1900° C. including the fact that energy costs to generate such higher temperatures will be increased significantly. The high temperatures will also create a more "aggressive" molten slag that may attack the refractory lining of the furnace, leading to shorter life of the refractory and the need for more frequent replacement thereof and thus more furnace "down time". Finally, undesired reactions, such as the production of carbon monoxide, can take place at these higher temperatures.

Another shortcoming of the process disclosed in U.S. Pat. No. 5,090,996 is that the slag composition must have a higher magnesium-oxide content than slags used in the existing Magnetherm Processes. At column 9, the patent discloses slag compositions having on the average 20%–25% magnesium-oxide. This means that more magnesium-oxide containing feed materials must be used to produce a given amount of magnesium vapor. Obviously, this fact negatively impacts on recovery rates and overall economic viability of the process.

Yet another shortcoming of the process disclosed in U.S. Pat. No. 5,090,996 is that the slag composition must be controlled by alternate feeding of the metal reductants, Al and Si (or FeSi). As is known to those skilled in the art, feed rates and feed amounts must be precisely controlled and it is easier to control a steady feed rate and amount than it is to precisely control alternating feed rates and amounts of metal reductants. Furthermore, the particular reductants alternated in U.S. Pat. No. 5,090,996 create a changing slag composition that can aggressively attack the refractory lining of the furnace leading to still other problems discussed above.

Therefore, there remains a need for a method of producing magnesium vapor at atmospheric pressure that overcomes the shortcomings of the prior art.

SUMMARY OF THE INVENTION

The method of this invention for producing magnesium vapor at substantially atmospheric pressure has met the above need. The method comprises feeding into the reaction zone of a furnace bath magnesium-oxide containing materials and metal reductants and then heating such materials and metal reductants in the reaction zone to an operating temperature to create a slag composition having a phase diagram that includes a two-phase, liquid and solid, region. The feeding of the magnesium-oxide containing material and the metal reductant into the furnace bath is controlled such that the slag composition at the operating temperature is within the two-phase liquid and solid region of the phase diagram. In this way, reactions occur to produce magnesium vapor at substantially atmospheric pressure.

The method of the invention also includes producing magnesium vapor substantially as is set forth above, transporting the magnesium vapor to a condenser and condensing the magnesium vapor to form magnesium metal.

The method of the invention is an improvement over the process disclosed in U.S. Pat. No. 5,090,996 in that the feeding of the magnesium-oxide containing materials and the metal reductants into the reduction furnace is such that the slag composition is within a two-phase liquid and solid region at the operating temperature. In this way, magnesium vapor at substantially atmospheric pressure is produced in the reaction zone of the reduction furnace.

BRIEF DESCRIPTION OF THE DRAWINGS

A full understanding of the invention can be gained from the following description of preferred embodiments when read in conjunction with the accompanying drawings in which.

DETAILED DESCRIPTION

Figure 1:
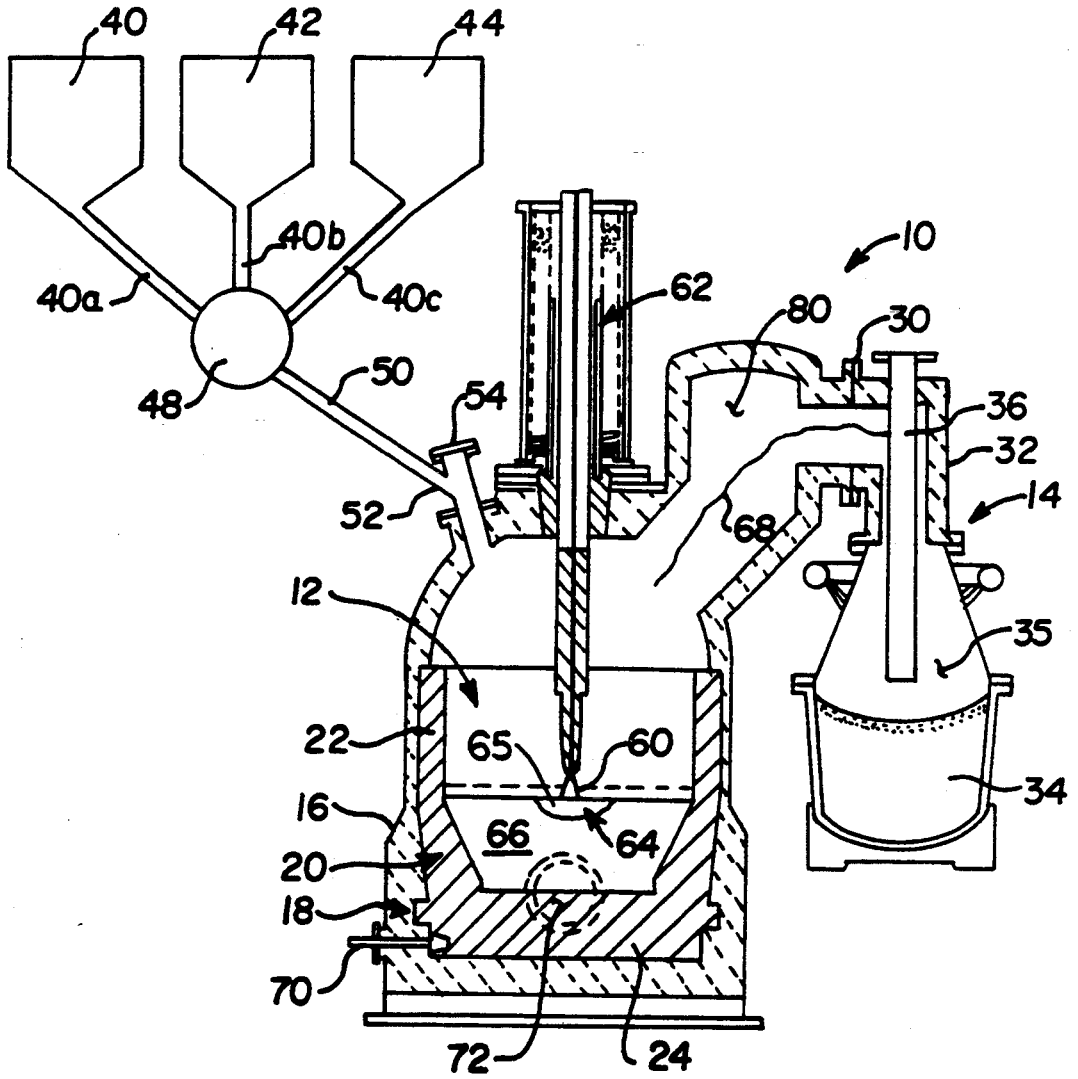
FIG. 1 is a partially schematic, partially elevational cross-section of a representative apparatus for producing magnesium vapor at atmospheric pressure by a method of the present invention.

Referring to FIG. 1, an apparatus 10 that can be used in carrying out the method of the invention is shown. It is to be understood, however, that FIG. 1 shows merely one configuration of an apparatus that can be used to produce magnesium vapor at substantially one atmosphere (760 torr pressure) and other existing or subsequently developed designs may also be used in accordance with the invention.

As used herein, the phrase "substantially atmospheric pressure" means a pressure between about 0.95 and about 1.05 atmospheres (about 722 torr to about 798 torr).

The apparatus 10 consists of a reduction furnace 12 and a condenser 14. The reduction furnace 12 has an outer body 16 made of steel, a refractory lining 18 and an inner carbon lining 20. The inner carbon lining 20 has an annular side portion 22 and a carbon hearth floor portion 24. The condenser 14 is joined to the outer body 16 by a flange connection 30. The upper portion of the condenser 14 includes a refractory lining 32 and a lower portion of the condenser consists of a crucible 34 which is preferably immersed in a tank of water (not shown) to cool the crucible so that magnesium metal is formed. The condenser 14 defines a condensation zone 35. The condenser 14 also includes a vacuum pipe 36 which leads to a vacuum pump (not shown). The vacuum pump removes so-called "off-gases" such as: argon introduced through the plasma arc; hydrogen from the small residual amounts of water left in the feed; and carbon monoxide produced by the residual carbon dioxide left in amount of uncalcined dolomite.

Feed materials which are fed into the reduction furnace 12 are provided from three hoppers 40, 42, 44, represented schematically in FIG. 1. For example, hopper 40 can contain chunks of ferrosilicon, hopper 42 can contain chunks of calcined magnesite and calcined dolomite and hopper 44 can contain pellets of aluminum. The feed materials are supplied from hoppers 40, 42, 44 via pipes 40*a*, 40*b* and 40*c* into a collection ball 48. It will be appreciated that the feeding of the materials into the collection ball 48 is precisely controlled in order to produce the desired slag compositions. As is known to those skilled in the art, various feeding apparatus, such as vibrating feeders and/or screw feeders can be used to move the feed materials from the hoppers 40, 42, 44 to pipes 40*a*, 40*b*, 40*c* and into collection ball 48.

In the collection ball 48, the feed materials are partially mixed and then delivered (by gravity) into inlet pipe 50. Inlet pipe 50 is mounted to an inlet port 52, which also includes a site port 54. The site port 54 allows an operator to look at the reduction furnace 12. It is to be understood, however, that other material delivery means can be used in accordance with the invention.

The feed materials are delivered into the reduction furnace 12 and are heated by a plasma arc 60 produced by a plasma electrode 62. The plasma arc 60 heats the feed materials in a reaction zone 64 to create molten slag 65 and a bulk slag composition 66. The heating of the feed materials creates a reaction which produces magnesium vapor 68. The plasma arc system is a so-called "transferred arc system", in that current generated by the plasma electrode 62 travels through the slag composition 66 and into the side portion 22 and carbon hearth portion 24 of the carbon lining 20 and then into a series of electrodes, only one of which, electrode 70, is shown in FIG. 1. The current gathered in the electrode is then carried back to the transformer (not shown) for subsequent return to the plasma electrode 62.

In order to maintain a proper amount of slag in the reduction furnace 12, the slag must be removed periodically (tapped) through tap hole 72. As will be discussed below, the slag must be somewhat liquid in order for the slag to flow through the tap hole 72. If the slag contains too high of a percent solids (over 50%) the slag does not flow easily and can be difficult to remove from the reduction furnace 12. Therefore, the temperature of the bulk slag is maintained at a minimum of about 1550° C. The slag in the reaction zone 64 directly under the plasma arc 60, however can be maintained at temperatures as much as 200°-300° C. hotter than the temperature of the bulk slag. It is the combination of these higher temperatures and the slag composition which produce magnesium vapor at one atmosphere pressure.

The magnesium vapor 68 is transported from the reaction zone 64 through a tuyere 80 and into the condensation zone 35 where it is condensed into liquid magnesium in the crucible 34. The magnesium vapor is transported from the molten slag 65 to the condenser due to the differential pressures caused by the condensation of the magnesium vapor to liquid magnesium. The differential pressures act like a pump, pumping the vapor from the molten slag 65 into the condenser 14.

Referring now to the slag composition and the actual production of magnesium vapor, it will be appreciated that in determining slag composition chemistry, many criteria are evaluated such as thermodynamics, tappability, cost and metal purity. One major advantage of plasma arc operation over conventional Magnetherm Processes is its insensitivity to the slag electrical resistivity. The conventional Magnetherm center electrode heats by passing alternating current through the slag bath. Thus, a change in slag composition changes the electrical characteristics of the furnace. In plasma arc, most of the heating is believed to occur at the slag surface as the ions and electrons produced in the arc recombine. A change in the slag resistivity should have minimal or no effect on the electrical characteristics of the system. Thus, it is believed that slag electrical resistivity may be ignored in determining slag composition chemistry.

As is known, two magnesium vapor producing reactions occur in the Magnetherm Process when using ferrosilicon and aluminum as metal reductants where the standard states are liquid Si and A1, periclase for MgO, high cristoballite for $SiO_2$ and corundum for $Al_2O_3$:

$$2MgO_{(s)}+Si_{(l)}=2Mg_{(g)}+SiO_{2(s)} \quad (1)$$

$$3MgO(s)+2Al(l)=3Mg(g)+Al_2O_3(s) \quad (2)$$

As ferrosilicon is a less expensive reductant than aluminum, it is advantageous to use as much ferrosilicon and as little aluminum as possible. Also, as aluminum is a much more powerful reductant than silicon, the aluminum will produce higher magnesium vapor pressures since reaction (2) is more thermodynamically favored than reaction (1). Therefore, reaction (1) will not go forward for certain slag compositions and thus is limits on the usable slag composition. In order to determine appropriate slag chemistry, attention must be focussed on reaction (1). The slag composition of the present invention was determined mostly by reference to reaction (1).

In determining the slag composition of the invention, slag activities must be calculated to determine whether a particular slag composition produces magnesium vapor at one atmosphere (1 atm.) pressure. A thermodynamic model developed by Henri Gaye and reported in Gaye et al., "Thermodynamics Of Slags: Use Of A Slag Model To Describe Metallurgical Reactions", *Memoires et Etudes Scientifiques Revue de Metallurgie,* 1989 86 (4) pp. 237–244 could be used to calculate activities of the components of potential slags as a function of both temperature and slag composition. The component ranges which produce potential slags and ultimately magnesium vapor at one atmosphere (1 atm.) pressure were as follows: 0–30% $SiO_2$; 0–30% $Al_2O_3$; 15–100% CaO; and 0–25% MgO. The temperatures used in the model were 1550° C., 1650° C., 1750° C. and 1850° C.

Once activities for the components were calculated for the ranges set forth above, the slags that potentially produce magnesium vapor at one atmosphere were determined by plotting all available activity data for MgO and $SiO_2$. It was then determined which compositions still produce magnesium vapor at one atmosphere pressure but have the lowest possible MgO content (which is desired because this will maximize recovery of magnesium) and the highest possible $SiO_2$ content (which is desired because the ferrosilicon metal reductant, is less expensive than aluminum metal reductant).

The above thermodynamic calculations determine whether a slag can generate magnesium vapor at one atmosphere pressure. This is only part of the determination of the appropriate slag chemistry in that certain physical characteristics of the slag, such as tappability, must also be determined. The physical characteristics of the slag such as the percent solids at reaction temperature, the percent solids at 1550° C., and the liquidus temperature are determined by analyzing phase diagrams. In addition, the phase diagrams can also be used to determine the crystallization path, i.e., the sequence in which different phases precipitate.

The percent solids at reaction temperature, while not a critical variable, does indicate the "piling" of solids under the plasma arc. A high percent solids at reaction temperature leads to excessive "piling" of the feed materials under the plasma arc which adversely affects dissolution of the dolime. Thus, a low percent solids (on the order of 10 to 20%) is desired.

The percent solids at 1550° C. is critical data that is determined from phase diagrams by examining the crystallization path. The temperature of the bulk slag that must be tapped from the furnace bath is about 1550° C. As was explained above with respect to FIG. 1, the temperature in the reaction zone under the plasma arc can be 200°–300° C. higher than that of the bulk slag. Thus, operating temperatures of 1750°–1850° C. are possible even though the bulk slag is at 1550° C. However, the bulk slag must be tappable at 1550° C. In order to be tappable, the bulk slag cannot have more than 50% solids at 1550° C.

The liquidus temperature is a check on both the percent solids at operating (or reaction) temperature and percent solids at 1550° C. A high liquidus temperature normally translates into a larger amount of solids at both operating and tapping temperatures.

After determining the thermodynamics and the physical characteristics of the slag composition, a mass balance to produce the slag is calculated.

Figure 2:
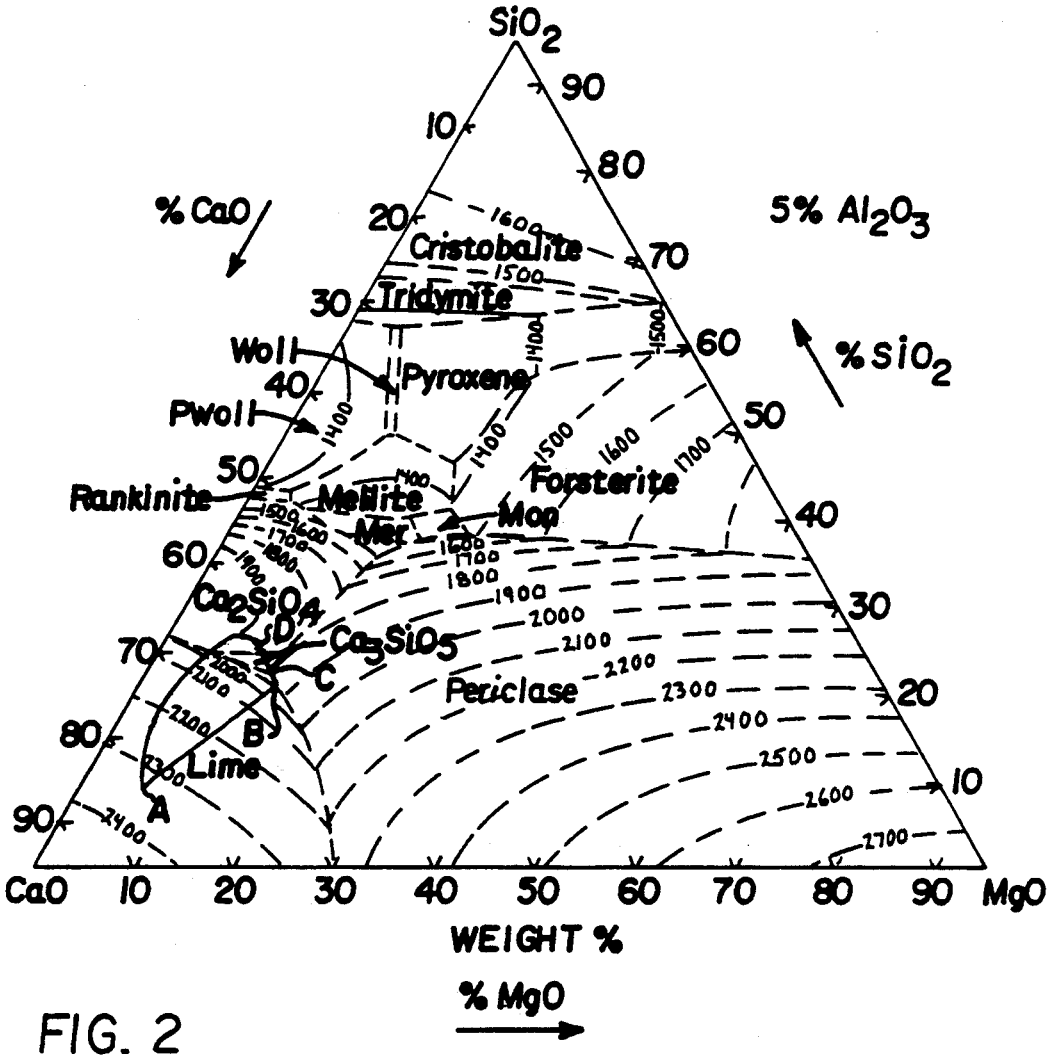
FIG. 2 is a four-component phase diagram showing the preferred concentrations of calcium oxide, magnesium-oxide and silicon dioxide in the slag at constant alumina concentration of about 5%.
Figure 3:
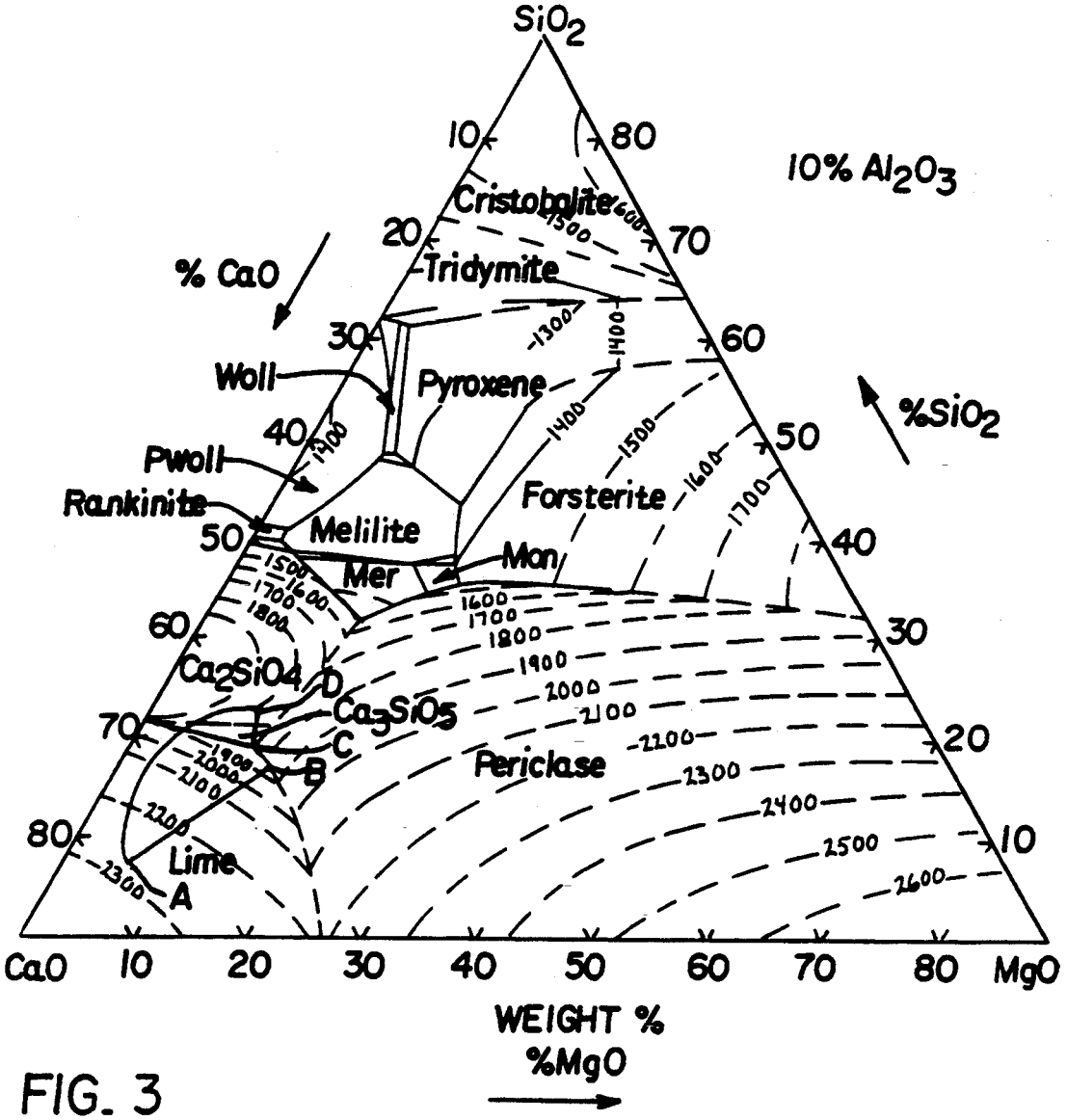
FIG. 3 is a four-component phase diagram showing the preferred concentrations of calcium oxide, magnesium-oxide and silicon dioxide in the slag at a constant alumina concentration of about 10%.
Figure 4:
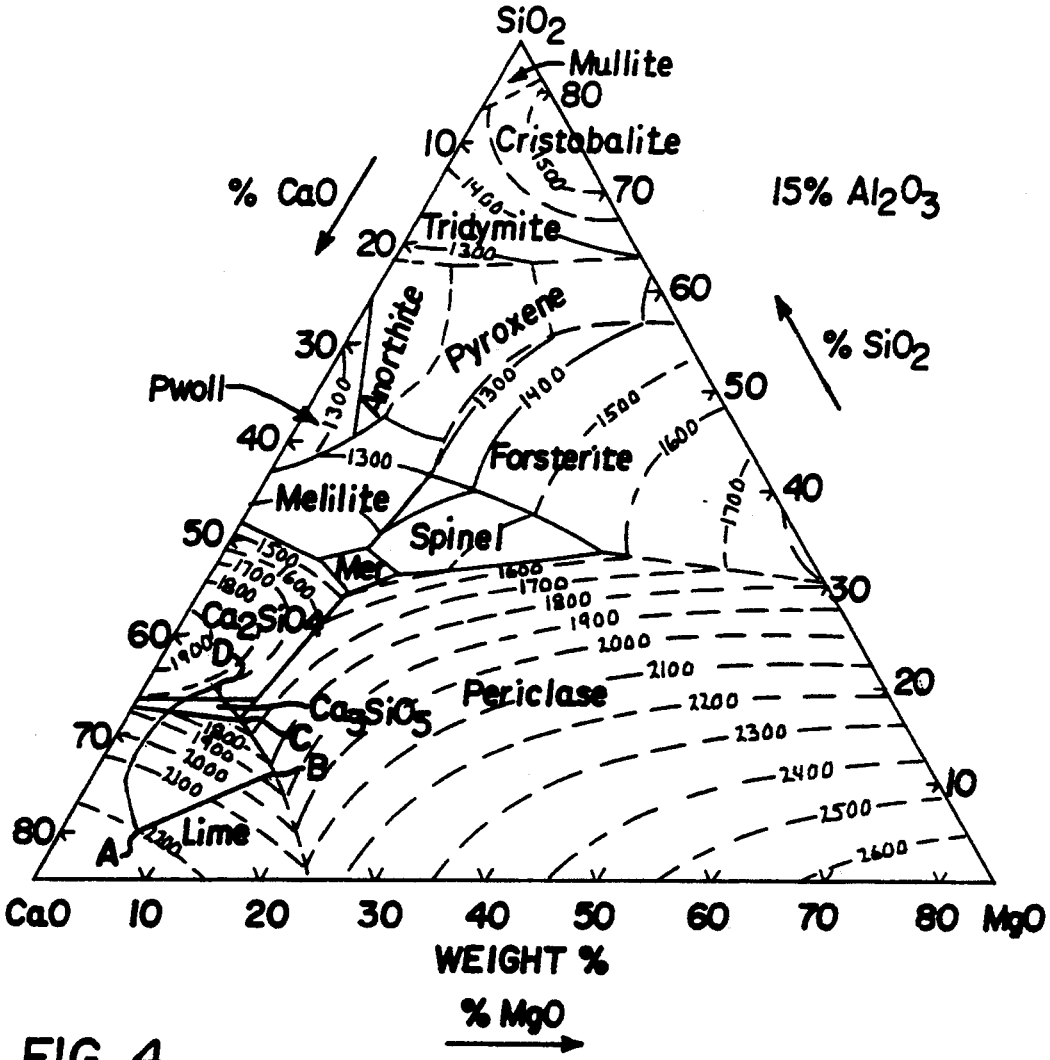
FIG. 4 is a four-component phase diagram showing the preferred concentrations of calcium oxide, magnesium-oxide and silicon dioxide in the slag at a constant alumina concentration of about 15%.

Referring now to FIGS. 2–4, the slag compositions of the invention are shown in the $CaO$-$SiO_2$-$MgO$-$Al_2O_3$ phase diagrams at constant alumina levels of about 5%, 10% and 15%, respectively. The preferred slag compositions are contained in the areas bounded by the points A-B-C-D. These slag compositions were determined by the general analysis set forth above. All of the slag compositions contained in the A-B-C-D areas shown on these three-phase diagrams are in the two-phase, liquid/solid region of each phase diagram. All such areas, A-B-C-D are not in the periclase region, but rather in either the lime region, the dicalcium silicate region or the tricalcium silicate region.

For each of the A-B-C-D areas shown on the phase diagrams of FIGS. 2–4, the line between A-B is determined by compositions that are magnesium oxide-saturated at 18502 C. This is because all slag compositions along the line between the CaO corner and a particular point on the two-phase boundary between the lime and periclase regions will be MgO saturated at the particular temperature of the intersection point. Point B is an intersection point at 1850° C. Thus, all compositions along A-B are MgO saturated at 1850° C., which is the maximum practical operating temperature for current Magnetherm furnace designs. The B-C line was determined by compositions that are magnesium oxide-saturated at lower temperatures. It will be noted that point C is at the intersection of the lime region boundary line and the tricalcium silicate boundary line. The C-D-A line was determined by plotting compositions with acceptable MgO and $SiO_2$ activities as calculated using the general approach set forth above and then fitting a curved line to the plotted points.

As can be seen from the areas A-B-C-D, the slag compositions of the invention which produce magnesium vapor at various operating temperatures from 1550°–1850° C. are about 50 to 80 weight percent CaO; about 3 to 15 weight percent MgO; about 5 to 15 weight percent $Al_2O_3$ and about 5 to 30 weight percent $SiO_2$. More preferably those compositions are about 55 to 70 weight percent CaO; about 3 to 10 weight percent MgO; about 5 to 15 weight percent $Al_2O_3$ and about 15 to 25 weight percent $SiO_2$. The preferred slag composition consists of about 63 weight percent CaO; 6 weight percent MgO; 10 weight percent $Al_2O_3$ and 21 weight percent $SiO_2$.

EXAMPLE

A two-phase liquid/solid slag composition which produces magnesium vapor at one atmospheric pressure was determined by the following procedure.

The equation for calculating the equilibrium constant at a given temperature is:

$$K = \frac{P_{MG}^2 * a_{SiO_2}}{a_{Si} * a_{MgO}^2} \quad (3)$$

An operating temperature of 1650° C. was selected. The equilibrium constant K at 1650° C. is equal to $1.03\times10^{-3}$. The activity of silicon at 1650° C. ($a_{Si}$) is equal to 0.0759. This activity was selected for an Si content in the residual FeSi equal to 20% to minimize carbon attack of the hearth by dissolution. For one atmosphere (1 atm.) pressure magnesium vapor, the activity of magnesium ($a_{Mg}$) and pressure of magnesium ($P_{Mg}$) both equal one. The activity of magnesium-oxide ($a_{MgO}$) is also equal to one at MgO saturation. Substituting these numbers into equation (3) and solving for $a_{SiO_2}$ resulted in an activity value of $a_{SiO_2}=7.82\times10^{-5}$. Therefore, the reaction of equation (1) (see above) will proceed for any slag which has $a_{MgO}=1$ and $a_{SiO_2}\leqq7.82\times10^{-5}$.

Using slag activity data from the Gaye et al. model mentioned above, iso-activity lines for MgO and $SiO_2$ were plotted. An optimum composition should have a minimum percentage of MgO (for maximizing recovery of magnesium) and a maximum percentage of $SiO_2$ (for lowest metal reductant costs). The intersection point of the iso-activity lines on the phase diagram has the minimum percentage MgO and the maximum percentage $SiO_2$. This optimized slag composition was determined to be $$CaO=63\%$$
$$MgO=6\%$$
$$Al_2O_3=10\% \text{ and}$$
$$SiO_2=21\%.$$

The physical characteristics of the above slag composition were then determined. Using phase diagrams, the liquidus temperature, the crystallization path sequence in which different phases precipitate, the % solids at reaction temperature (1650° C.) and the % solids at tapping temperature (1550° C.) were calculated. The liquidus temperature was 1850° C.; the % solids at 1650° C. was calculated at 25% and the % solids at 1550° C. was calculated at 50%. This slag composition should have acceptable physical characteristics.

A mass balance was then determined to produce the above slag composition. This balance requires a small amount of lime (CaO) addition, but otherwise uses typical dolime, aluminum and ferrosilicon, though in different proportions to the conventional Magnetherm Process.

It will be appreciated that the slag compositions contained within areas A-B-C-D of FIGS. 2-4 were all determined by the above procedure. Those slag compositions will produce magnesium vapor at one atmosphere (1 atm.) pressure.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of producing magnesium vapor at substantially atmospheric pressure in a reaction zone of a reduction furnace, said method comprising:

feeding into said reduction furnace magnesium-oxide containing materials and metal reductants;

heating said magnesium-oxide containing materials and said metal reductants in said reaction zone to an operating temperature to create a slag composition having a phase diagram including a two-phase liquid and solid region; and controlling said feeding of said magnesium-oxide containing materials and said metal reductants into said reduction furnace such that said slag composition is within said two-phase liquid and solid region at said operating temperature, whereby magnesium vapor at substantially atmospheric pressure is produced in said reaction zone.

2. The method of claim 1, wherein said slag composition includes between about 3 to 15 weight percent magnesium-oxide.

3. The method of claim 2, wherein said slag composition includes between about 4 to 6 weight percent magnesium-oxide.

4. The method of claim 1, wherein said operating temperature is between about 1550°-1850° C. (2800° F.-3350° F.).

5. The method of claim 4, wherein said operating temperature is between about 1600°-1700° C. (2900° F.-3100° F.).

6. The method of claim 1, wherein said slag composition includes about 50 to 80 weight percent CaO; about 3 to 15 weight percent MgO; about 5 to 15 weight percent $Al_2O_3$; and about 5 to 30 weight percent $SiO_2$.

7. The method of claim 6, wherein said slag composition includes about 55 to 70 weight percent CaO; about 3 to 10 weight percent MgO; about 5 to 15 weight percent $Al_2O_3$; and about 15 to 25 weight percent $SiO_2$.

8. The method of claim 7, wherein said slag composition includes about 63 weight percent CaO; about 6 weight percent MgO; about 10 weight percent $Al_2O_3$; and about 21 weight percent $SiO_2$.

9. The method of claim 1, wherein said phase diagram includes a lime region; and said slag composition is within said lime region.

10. The method of claim 1, wherein said phase diagram includes a dicalcium silicate region; and said slag composition is within said dicalcium silicate region.

11. The method of claim 1, wherein said phase diagram includes a tricalcium silicate region; and said slag composition is within said tricalcium silicate region.

12. A method of producing magnesium metal comprising:

providing (i) a reduction furnace having a reaction zone and (ii) condenser means defining a condensation zone;

feeding into said reduction furnace magnesium-oxide containing materials and metal reductants;

heating said magnesium-oxide containing materials and said metal reductants in said reaction zone to an operating temperature to create a slag composition having a phase diagram including a two-phase liquid and solid region:

controlling said feeding of said magnesium-oxide containing materials and said metal reductants into said reduction furnace such that said slag composition is within said two-phase liquid and solid region wherein magnesium vapor at substantially atmospheric pressure is produced in said reaction zone;

transporting said magnesium vapor from said reaction zone to said condensation zone of said condenser means; and condensing said magnesium vapor in said condensation zone.

13. The method of claim 12, wherein said reaction zone has a surface; and heating said surface of said reaction zone by means of a transferred arc thermal plasma.

14. The method of claim 13, wherein said operating temperature is between about 1550°–1850° C. (2800° F.–3350° F.).

15. The method of claim 14, wherein said operating temperature is between about 1600°–1700° C. (2900° F.–3100° F.).

16. The method of claim 12, wherein said slag composition includes about 50 to 80 weight percent CaO; about 3 to 15 weight percent MgO; about 5 to 15 weight percent $Al_2O_3$; and about 5 to 30 weight percent $SiO_2$.

17. The method of claim 16, wherein said slag composition includes about 55 to 70 weight percent CaO; about 3 to 10 weight percent MgO; about 5 to 15 weight percent $Al_2O_3$; and about 15 to 25 weight percent $SiO_2$.

18. The method of claim 17, wherein said slag composition includes about 63 weight percent CaO; about 6 weight percent MgO; about 10 weight percent $Al_2O_3$; and about 21 weight percent $SiO_2$.

19. The method of claim 12, wherein said phase diagram includes a lime region, a dicalcium silicate region and a tricalcium silicate region; and said slag composition is in one of said lime region, said dicalcium silicate region and said tricalcium silicate region.

* * * * *